US011456111B2

(12) United States Patent
Kang et al.

(10) Patent No.: US 11,456,111 B2
(45) Date of Patent: Sep. 27, 2022

(54) COIL COMPONENT

(71) Applicant: SAMSUNG ELECTRO-MECHANICS CO., LTD., Suwon-si (KR)

(72) Inventors: Byung Soo Kang, Suwon-si (KR); Ju Hwan Yang, Suwon-si (KR); Byeong Cheol Moon, Suwon-si (KR); Yong Hui Li, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 646 days.

(21) Appl. No.: 16/352,190

(22) Filed: Mar. 13, 2019

(65) Prior Publication Data

US 2020/0013540 A1 Jan. 9, 2020

(30) Foreign Application Priority Data

Jul. 5, 2018 (KR) ..... 10-2018-0078134

(51) Int. Cl.

| | |
|---|---|
| ***H01F 5/00*** | (2006.01) |
| ***H01F 27/29*** | (2006.01) |
| ***H01F 27/32*** | (2006.01) |
| ***H01F 27/28*** | (2006.01) |

(52) U.S. Cl.

CPC ..... *H01F 27/29* (2013.01); *H01F 27/2804* (2013.01); *H01F 27/323* (2013.01); *H01F 2027/2809* (2013.01)

(58) Field of Classification Search

USPC ..... 336/200

See application file for complete search history.

(56) References Cited

U.S. PATENT DOCUMENTS

| | | | | |
|---|---|---|---|---|
| 2015/0048915 | A1* | 2/2015 | Yoon | H01F 17/0013 336/192 |
| 2018/0096783 | A1* | 4/2018 | Fukuda | H01F 27/346 |
| 2018/0182537 | A1* | 6/2018 | Shimizu | H01F 27/292 |

FOREIGN PATENT DOCUMENTS

| | | | |
|---|---|---|---|
| KR | 10-2015-0019730 | A | 2/2015 |
| KR | 10-2016-0031391 | A | 3/2016 |

* cited by examiner

*Primary Examiner* — Ronald Hinson

(74) *Attorney, Agent, or Firm* — Morgan, Lewis & Bockius LLP

(57) ABSTRACT

A coil component includes a body having one surface and another surface opposing each other and a plurality of wall surfaces each connecting the one surface to the other surface of the body. A pair of recesses are disposed in a respective end surface of a pair of opposing end surfaces of the body and each extend to the one surface. A coil portion includes first and second lead-out portions disposed on a surface of an internal insulating layer embedded in the body, and the coil portion is exposed to an internal wall and a bottom surface of each of the pair of recesses. First and second external electrodes are each disposed along the internal wall of a respective recess and along the one surface of the body to be connected to the coil portion, and are spaced apart from each other on the one surface of the body.

27 Claims, 12 Drawing Sheets

COIL COMPONENT

CROSS-REFERENCE TO RELATED APPLICATION(S)

This application claims benefit of priority to Korean Patent Application No. 10-2018-0078134 filed on Jul. 5, 2018 in the Korean Intellectual Property Office, the disclosure of which is incorporated herein by reference in its entirety.

BACKGROUND

1. Field

The present disclosure relates to a coil component.

2. Description of Related Art

An inductor is a type of coil component and is a representative passive electronic component, used in electronic devices, along with resistors and capacitors.

With the trend for compact, high-performance electronic devices, electronic components for use in electronic devices are increasing in number while decreasing in size.

Generally, an external electrode of a coil component is formed using a conductive paste or is formed through a plating process. In the case in which an external electrode of a coil component is formed using a conductive paste, the coil component may increase in thickness because the external electrode increases in thickness. In the case in which an external electrode of a coil component is formed through a plating process, the number of processes may increase because a plating resist necessary for plating should be formed.

SUMMARY

An aspect of the present disclosure is to provide a coil component which may be lighter, thinner, shorter, and smaller.

Another aspect of the present disclosure is to provide a coil component which may form an electrode structure.

Another aspect of the present disclosure is to provide a coil component which may form a shielding structure to reduce leakage flux.

According to an aspect of the present disclosure, a coil component includes a body having one surface and another surface, disposed to oppose each other in one direction, and a plurality of wall surfaces connecting the one surface of the body to the other surface of the body. An internal insulating layer is embedded in the body. A pair of recesses are each disposed in a respective end surface of a pair of opposing end surfaces of the body among the plurality of wall surfaces of the body, and each extend to the one surface of the body. A coil portion includes first and second lead-out portions disposed on one surface of the internal insulating layer to be spaced apart from each other, and the coil portion is exposed to an internal wall and a bottom surface of each of the pair of recesses. First and second external electrodes are each disposed along the internal wall of a respective one of the pair of recesses and are each disposed along the one surface of the body to be connected to the coil portion. The first and second external electrodes are disposed on the one surface of the body to be spaced apart from each other.

In accordance with another aspect of the disclosure, a coil component includes a body having first and second surfaces opposing each other in a first direction, third and fourth surfaces opposing each other in a second direction, and fifth and sixth surfaces opposing each other in a third direction. A coil is disposed in the body to be substantially parallel to the first surface and spaced apart from the first surface, and includes first and second lead-out portions connected to respective ends of the coil. First and second recesses are disposed in the third and fourth surfaces of the body, respectively, and each extend from the first and second lead-out portions, respectively, to the first surface of the body. First and second external electrodes are disposed in the first and second recesses, respectively, are connected to the first and second lead-out portions, respectively, and are disposed on the first surface of the body to be spaced apart from each other.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
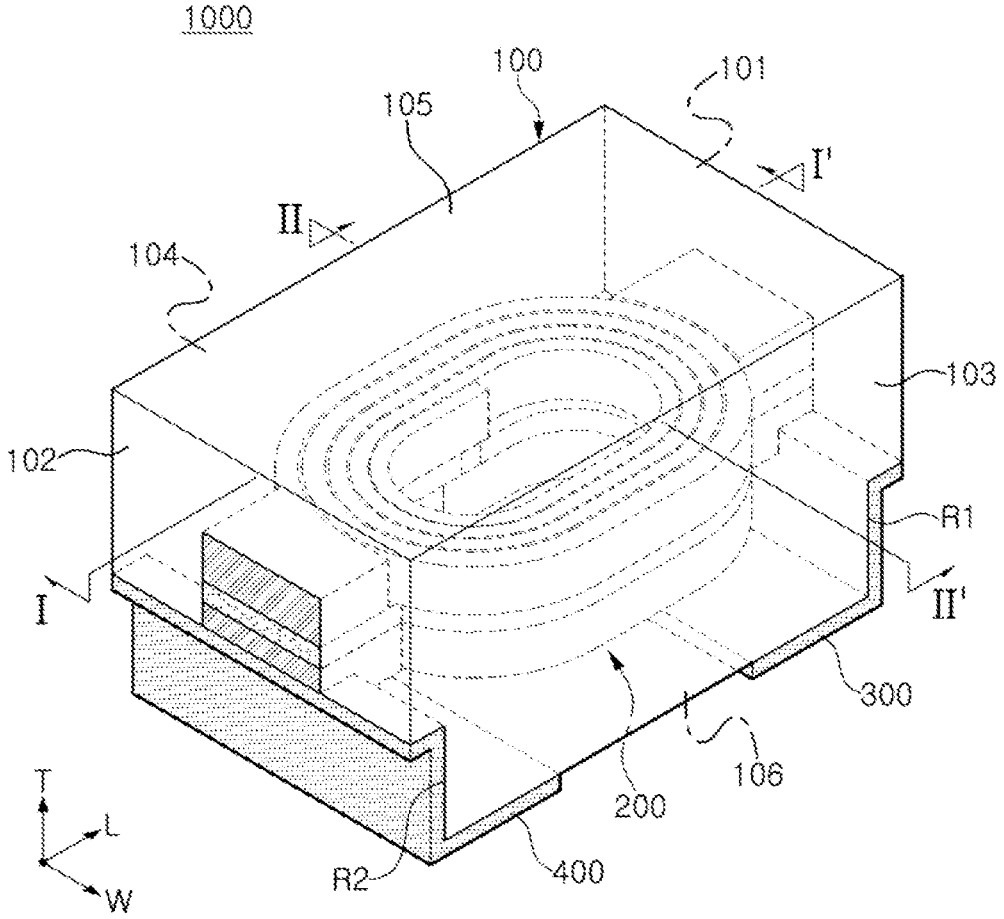
FIG. 1 illustrates a coil component according to a first exemplary embodiment in the present disclosure.

Hereinafter, embodiments of the present disclosure will be described as follows with reference to the attached drawings.

The terminology used herein to describe embodiments is not intended to limit the scope of the present disclosure. The articles "a," "an," and "the" are singular in that they have a single referent, however, the use of the singular form in the present document should not preclude the presence of more than one referent. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof. In addition, in the specification, "on" means to be located above or below an object portion, and does not necessarily mean that the object is located upward with reference to the gravitational direction.

Furthermore, the term "coupling" is used as the concept including not only the case of direct physical contact between the respective components but also the case where another component is interposed between the respective components and the component is in contact with the other configuration, in the contact relation between components.

The size and thickness of each of the components illustrated in the drawings are shown for convenience of explanation and the present disclosure is not necessarily limited thereto.

In the drawings, 'L' direction may be defined as a first direction or a length direction, 'W' direction may be defined as a second direction or a width direction, and 'T' direction may be defined as a third direction or a thickness direction.

Hereinafter, a coil component according to an exemplary embodiment in the present disclosure will be described in detail with reference to the accompanying drawings. In the following description with reference to the accompanying drawings, the same reference numerals are assigned to the same or corresponding components, and redundant descriptions thereof will be omitted.

Various types of electronic component are used in electronic devices. Various types of coil component may be appropriately used between these electronic components to remove noise and the like.

For example, a coil component in an electronic device may be used as a power inductor, a high-frequency (HF) inductor, a general bead, a GHz bead, a common mode filter, or the like.

First Embodiment

Figure 2:
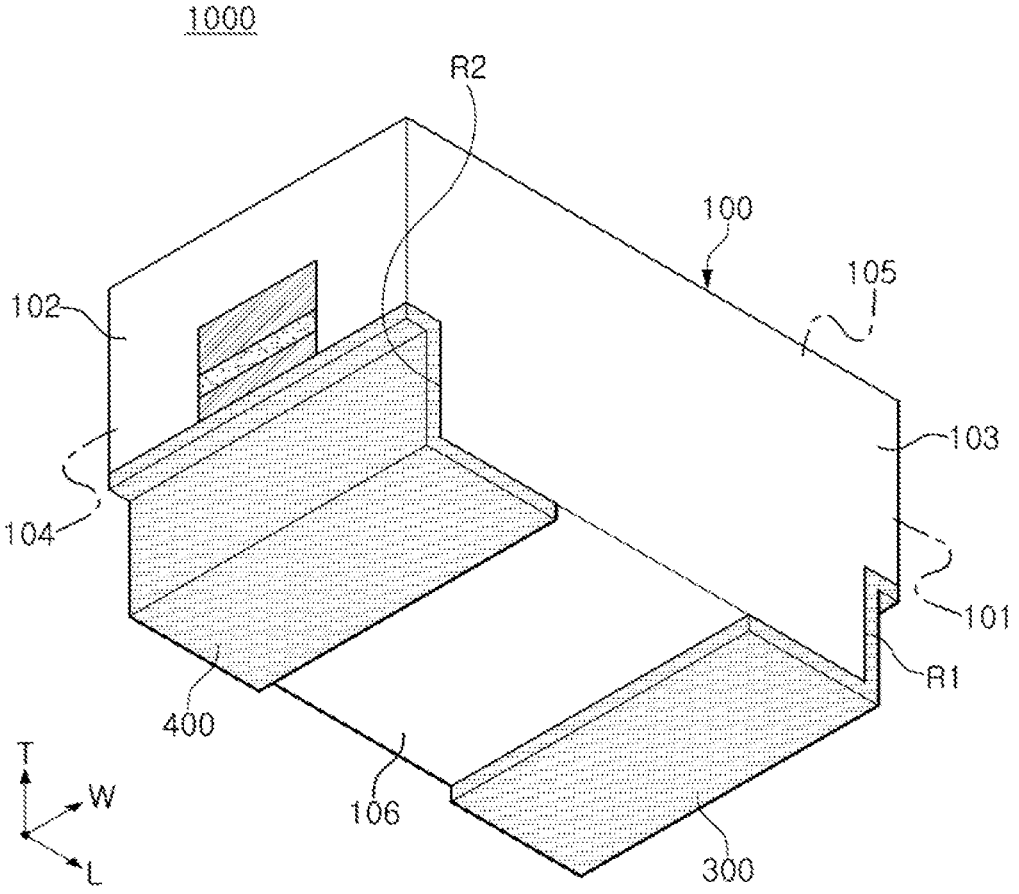
FIG. 2 illustrates the coil component, according to the first exemplary embodiment in the present disclosure, when viewed from below.
Figure 3:
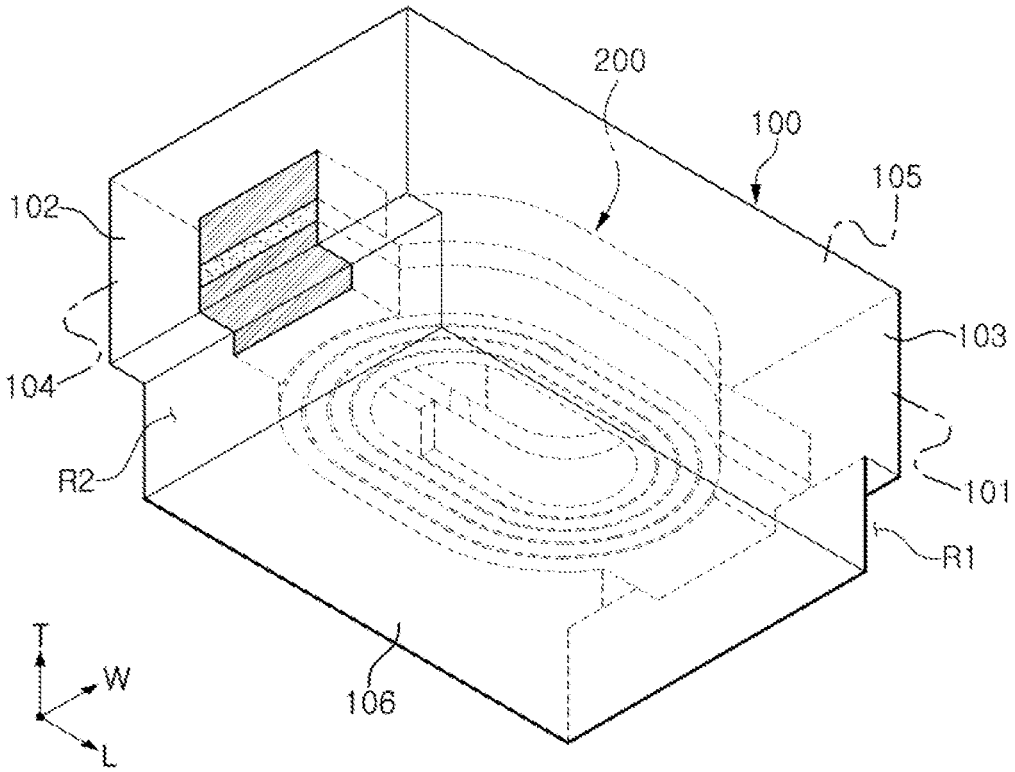
FIG. 3 is a view obtained by omitting some portions of a configuration in FIG. 2.
Figure 4:
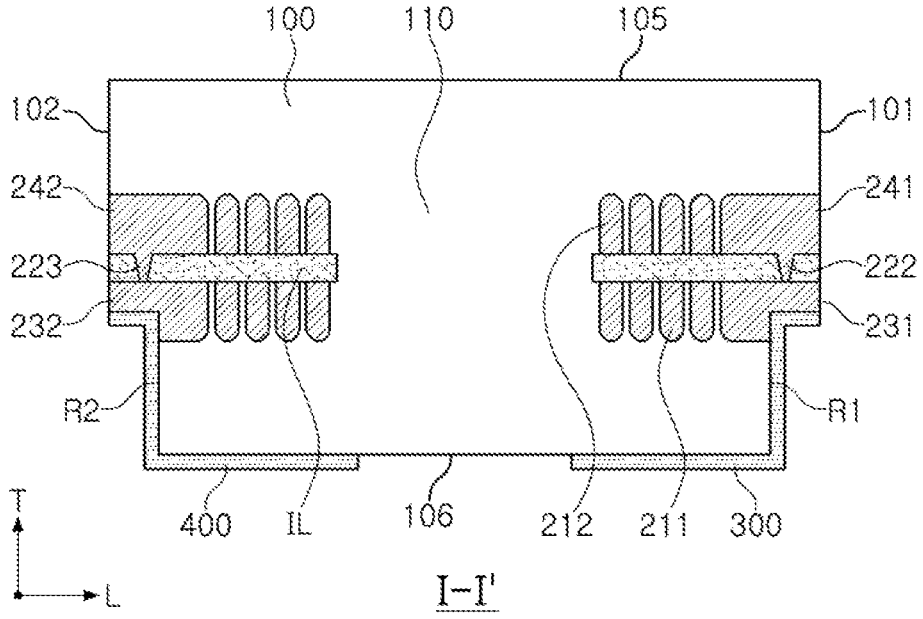
FIG. 4 is a cross-sectional view taken along line I-I' in FIG. 1.
Figure 5:
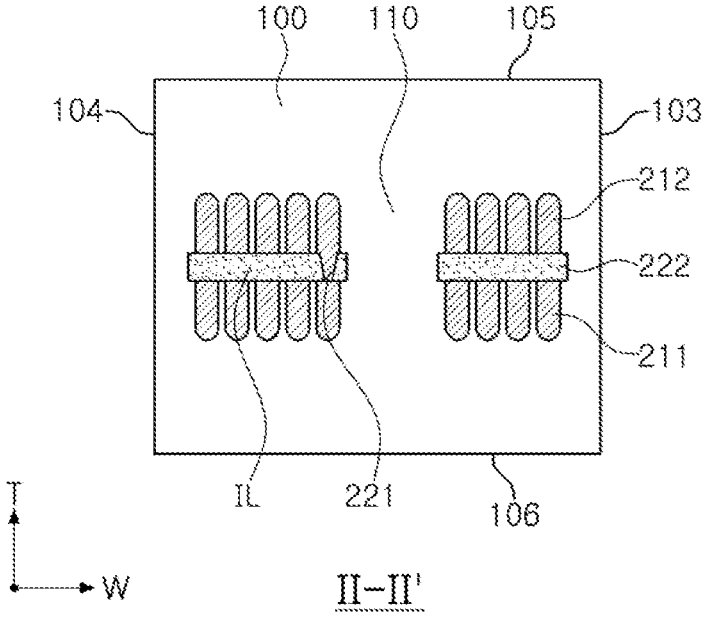
FIG. 5 is a cross-sectional view taken along line II-II' in FIG. 1.
Figure 6:
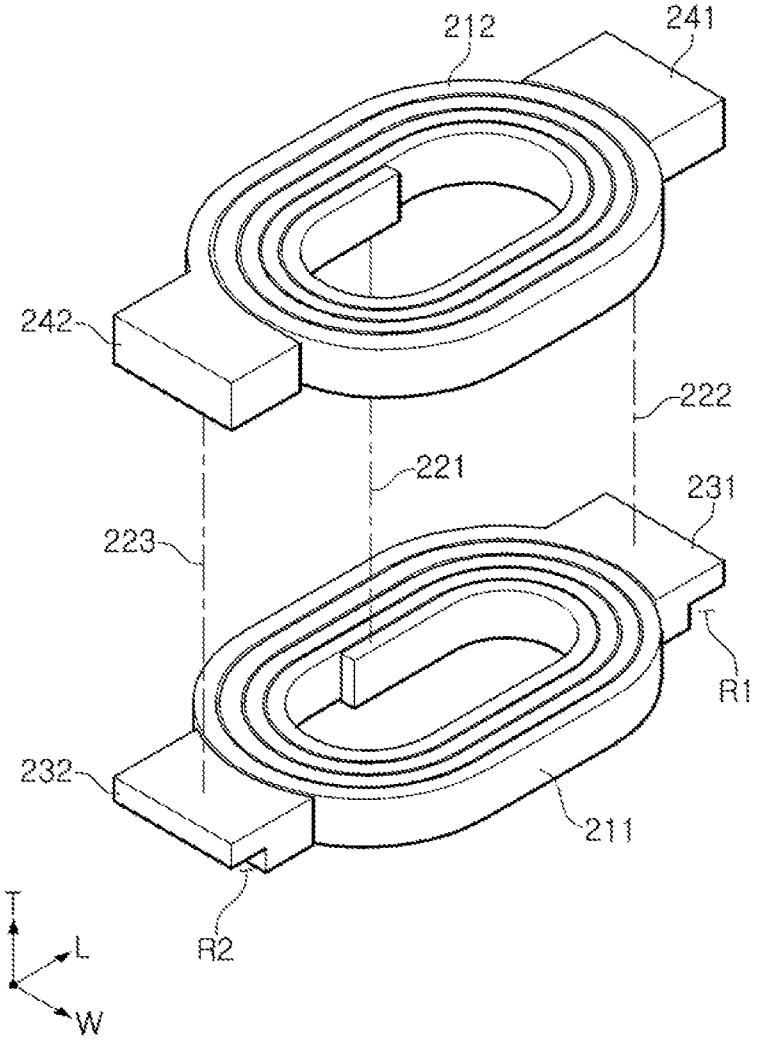
FIG. 6 is an exploded perspective view of a coil portion.

FIG. 1 illustrates a coil component according to a first exemplary embodiment in the present disclosure. FIG. 2 illustrates the coil component, according to the first exemplary embodiment in the present disclosure, when viewed from below, and FIG. 3 is a view obtained by omitting some portions of a configuration in FIG. 2. FIG. 4 is a cross-sectional view taken along line I-I' in FIG. 1, and FIG. 5 is a cross-sectional view taken along line II-II' in FIG. 1. FIG. 6 is an exploded perspective view of a coil portion.

Referring to FIGS. 1 to 6, a coil component 1000 according to an exemplary embodiment may include a body 100, an internal insulating layer IL, recesses R1 and R2, a coil portion 200, and external electrodes 300 and 400.

The body 100 forms an external appearance of the coil component 1000 according to an exemplary embodiment, and the coil portion 200 is embedded in the body 100.

The body 100 may be formed to have a substantially hexahedral shape.

Referring to FIG. 1, the body 100 includes a first surface 101 and a second surface 102 disposed to oppose each other in a length direction 'L', a third surface 103 and a fourth surface 104 disposed to oppose each other in a width direction 'W', and a fifth surface 105 and a sixth surface 106 disposed to oppose each other in a thickness direction 'T'. Each of the first to fourth surfaces 101, 102, 103, and 104 of the body 100 may correspond to a wall of the body 100 connecting the fifth surface 105 and the sixth surface 106 of the body 100 to each other. Hereinafter, both end surfaces of the body 100 may refer to the first surface 101 and the second surface 102 of the body 100, and both side surfaces of the body 100 may refer to the third surface 103 and the fourth surface 104 of the body 100.

The body 100 may be formed in such a manner that the coil component 1000 according to an exemplary embodiment, in which the external electrodes 300 and 400 described later are formed, has a length of 2.0 millimeters (mm), a width of 1.2 mm, and a thickness of 0.65 mm, but the length, the width, and the thickness thereof may not be limited thereto.

The body 100 may include a magnetic material and a resin. Specifically, the body 100 may be formed by laminating one or more magnetic composite sheets, each including a magnetic material dispersed in a resin. However, the body 100 may have another structure in addition to a structure in which the magnetic material is dispersed in the resin. For example, the body 100 may be formed of a magnetic material such as ferrite.

The magnetic material may be ferrite or magnetic metal powder particles.

For example, the ferrite includes at least one or more of spinel-type ferrite such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, or the like, hexagonal ferrite such as Ba—Zn-based ferrite, Ba—Mg-based ferrite, Ba—Ni-based ferrite, Ba—Co-based ferrite, Ba—Ni—Co-based ferrite, or the like, or garnet ferrite such as Y-based ferrite, Li-based ferrite, and the like.

The magnetic metal powder particles may include at least one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may be at least one or more of pure iron powder particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The magnetic metal powder particles may be amorphous or crystalline. For example, the magnetic metal powder particles may be Fe—Si—B—Cr-based amorphous alloy powder, but are not limited thereto.

Each of the ferrite and the magnetic metal powder may have an average grain diameter of about 0.1 micrometer (μm) to 30 μm, but an average grain diameter thereof is not limited thereto.

The body 100 may include two or more types of magnetic materials dispersed in resin. The phrase "different types of magnetic materials" mean that the magnetic materials dispersed in the resin are distinguished from each other by one of an average grain diameter, composition, crystallizability, and a shape.

The resin may include, but is not limited to, epoxy, polyimide, liquid crystal polymer, and the like, either alone or in combination.

The body 100 includes a core 110 penetrating the coil portion 200 to be described later. The magnetic composite sheet may fill through-holes of the coil portion 200 to form the core 110, but a manner of forming the core 110 is not limited thereto.

The recesses R1 and R2 are formed on the first and second surfaces 101 and 102 of the body 100, respectively. Each of the recesses R1 and R2 extends to the sixth surface 106 of the body 100. For example, the first recess R1 is formed on the first surface 101 of the body 100 and extends to the sixth surface 106 of the body 100. The second recess R2 is formed on the second surface 102 of the body 100 and extends to the sixth surface 106 of the body 100. Each of the first and second recesses R1 and R2 does not extend to the fifth surface 105 of the body 100. For example, the recesses R1 and R2 do not penetrate the body 100 through the thickness direction of the body 100.

In the present embodiment, the recesses R1 and R2 extend to the third and fourth faces 103 and 104 of the body 100 in the width direction of the body 100. For example, the recesses R1 and R2 may be slits formed in the width direction of the body 100 as a whole. The recesses R1 and R2 may be formed by performing pre-dicing on one surface of a coil bar along a boundary line, matching the width direction of each coil component, among boundary lines each individualizing a coil component, in the coil bar before each coil component is individualized. A depth of the pre-dicing is controlled in such a manner that lead-out portions 231 and 232 to be described later are exposed to bottom surfaces and internal walls of the recesses R1 and R2, respectively.

Internal walls of the recesses R1 and R2 and bottom surfaces of the recesses R1 and R2 also constitute the surface of the body 100. However, for ease of description, the internal walls and the bottom surfaces of the recesses R1 and R2 will be distinguished from the surface of the body 100 in the specification.

The internal insulating layer IL is embedded in the body 100. The internal insulating layer IL is configured to support the coil portion 200 to be described later.

The internal insulating layer IL may be formed of an insulating material including a thermosetting insulating resin such as an epoxy resin, a thermoplastic insulating resin such as polyimide, or a photosensitive insulating resin or may be formed of an insulating material impregnated with a reinforcing material such as a glass fiber or an inorganic filler in the insulating resin. For example, the internal insulating layer IL may be formed of an insulating material such as prepreg, an Ajinomoto Build-up Film (ABF), FR-4, Bismaleimide Triazine (BT) resin, Photo Imageable Dielectric (PID), and the like, but examples thereof may not be limited thereto.

At least one or more selected from the group composed of silica ($SiO_2$), alumina ($Al_2O_3$), silicon carbide (SiC), barium sulfate ($BaSO_4$), talcum powder, clay, mica powders, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used as the inorganic filler.

When the internal insulating layer IL is formed of an insulating material including the reinforcing material, the internal insulating layer IL may provide better rigidity. When the internal insulating layer IL is formed of an insulating material that does not include a glass fiber, the internal insulating layer IL is advantageous in thinning the entire coil portion 200. When the internal insulating layer IL is formed of an insulating material including a photosensitive insulating resin, the number of processes for forming the coil portion 200 may be decreased to advantageously reduce the manufacturing cost and to form a fine via.

The coil portion 200 is embedded in the body 100 and operates depending on the characteristics of a coil component. For example, when the coil component 1000 according to an exemplary embodiment in the present disclosure is used as a power inductor, the coil portion 200 may operate to stabilize the power of an electronic device by storing the electric field as a magnetic field to maintain the output voltage.

The coil portion 200 includes coil patterns 211 and 212, lead-out portions 231 and 232, auxiliary lead-out portions 241 and 242, and vias 221, 222, and 223.

Specifically, referring to FIGS. 1, 4, and 5, a first coil pattern 211, a first lead-out portion 231, and a second lead-out portion 232 are disposed on a bottom surface of the internal insulating layer IL, and disposed to oppose or face the sixth surface 106 of the body 100. A second coil pattern 212, a first auxiliary lead-out portion 241, and a second auxiliary lead-out portion 242 are disposed on a top surface of the internal insulating layer IL, and disposed to oppose or face away from the bottom surface of the internal insulating layer IL. The first coil pattern 211 is in contact with the first lead-out portion 231 on the bottom surface of the internal insulating layer IL, and the first coil pattern 211 and the first lead-out portion 231 are spaced apart from the second lead-out portion 232. The second coil pattern 212 is in contact with the second auxiliary lead-out portion 242 on the top surface of the internal insulating layer IL, and the second coil pattern 212 and the second auxiliary lead-out portion 242 are spaced apart from the first auxiliary lead-out portion 241. The first via 221 penetrates the internal insulating layer IL to be in contact with each of the first coil pattern 211 and the second coil pattern 212. The second via 222 penetrates the internal insulating layer IL to be in contact with each of the first lead-out portion 231 and the first auxiliary lead-out portion 241. The third via 223 penetrates the internal insulating layer IL to be in contact with each of the second lead-out portion 232 and the second auxiliary lead-out portion 242. As described above, the coil portion 200 may operate as a single coil as a whole.

Each of the first coil pattern 211 and the second coil pattern 212 may have a shape of a planar helix forming at least one turn about the core 110. For example, the first coil pattern 211 may form at least one turn about the core 110 on the bottom surface of the internal insulating layer IL.

The recesses R1 and R2 extend to the first lead-out portion 231 and the second lead-out portion 232, respectively. For this reason, the first lead-out portion 231 is exposed to each of the bottom surface (e.g., a surface of the recess R1 that is parallel to lower surface 106) and the internal wall of the first recess R1 (e.g., a surface of the recess R1 that is parallel to end surface 101), and the second lead-out portion 232 is exposed to each of the bottom surface (e.g., a surface of the recess R2 that is parallel to lower surface 106) and the internal wall of the second recess R2 (e.g., a surface of the recess R2 that is parallel to end surface 102). The external electrodes 300 and 400 to be described later are respectively formed at the lead-out portions 231 and 232 exposed to the bottom surfaces and the internal walls of the recesses R1 and R2, and the external electrodes 300 and 400 are connected to the coil portion 200.

The surfaces of the lead-out portions 231 and 232, exposed to the internal walls and the bottom surfaces of the recesses R1 and R2, may have higher surface roughness than the other surfaces of the lead-out portions 231 and 232. For example, when the lead-out portions 231 and 232 are formed by electrolytic plating and the recesses R1 and R2 are formed in the lead-out portions 231 and 232 and the body 100, a portion of the lead-out portions 231 and 232 is removed during a process to form a recess. As described above, the surfaces of the lead-out portions 231 and 232, exposed to the internal walls and the bottom surfaces of the recesses R1 and R2, have higher surface roughness than the other surfaces of the lead-out portions 231 and 232 due to polishing of dicing tips. As will be described below, since each of the external electrodes 300 and 400 may be formed as a thin film, the bonding force to the body 100 may be decreased. Since the external electrodes 300 and 400 are in contact with surfaces of the lead-out portions 231 and 232 having relatively higher surface roughness, respectively, the bonding force between the external electrodes 300 and 400 and the lead-out portions 231 and 232 may be improved.

The lead-out portions 231 and 232 and the auxiliary lead-out portions 241 and 242 are exposed to end surfaces 101 and 102 of the body 100, respectively. For example, the first lead-out portion 231 is exposed to the first surface 101 of the body 100, and the second lead-out portion 232 is exposed to the second surface 102 of the body 100. In addition, the first auxiliary lead-out portion 241 is exposed to the first surface 101 of the body 100, and the second auxiliary lead-out portion 242 is exposed to the second surface 102 of the body 100. As described above, the first lead-out portion 231 is continuously exposed to the internal wall of the first recess R1, the bottom surface of the first recess R1, and the first surface 101 of the body 100, and the second lead-out portion 232 is continuously exposed to the internal wall of the second recess R2, the bottom surface of the second recess R2, and the second surface 102 of the body 100.

At least one of the coil patterns 211 and 212, the vias 221, 222, and 223, the lead-out portions 231 and 232, and the auxiliary lead-out portions 241 and 242 may include at least one or more conductive layers.

For example, when the second coil pattern 212, the auxiliary lead-out portions 241 and 242, and the vias 221, 222, and 223 are formed on a side of the other surface of the internal insulating layer IL by plating, each of the second coil pattern 212, the auxiliary lead-out portions 241 and 242, and the vias 221, 222, and 223 may include a seed layer of an electroless plating layer or the like and an electrolytic plating layer. The electrolytic plating layer may have a monolayer structure or a multilayer structure. The electrolytic plating layer of the multilayer structure may be formed of a conformal film structure in which one electrolytic plating layer is covered with another electrolytic plating layer, and the electrolytic plating layer may be formed by laminating another electrolytic plating layer on only one surface of one electrolytic plating layer. Since the seed layer of the second coil pattern 212, the seed layers of the auxiliary leads 241 and 242 and the seed layers of the vias 221, 222, and 223 are integrated as a single body, the boundary between each other may not be formed, but may not be limited thereto. Since the electrolytic plating layer of the second coil pattern 212, the electrolytic plating layers of the auxiliary lead-out portions 241 and 242, and the electrolytic plating layers of the vias 221, 222, and 223 are integrated as a single body, the boundary between each other may not be formed, but may not be limited thereto.

As another example, with reference to FIGS. 1 to 5, the first coil pattern 211 and the lead-out portions 231 and 232, disposed on the bottom surface of the internal insulating layer IL, and the second coil pattern 212 and the auxiliary lead-out portions 241 and 242, disposed on the top surface of the internal insulating layer IL, are formed separately from each other. Then, when the coil portion 200 is formed by collectively laminating the first coil pattern 211 and the lead-out portions 231 and 232, the second coil pattern 212, and the auxiliary lead-out portions 241 and 242 on the internal insulating layer IL, the vias 221, 222, and 223 may include a high melting point metal layer and a low melting point metal layer having a melting point lower than the melting point of the high melting point metal layer. The low melting point metal layer may be formed of solder including lead (Pb) and/or tin (Sn). At least a portion of the low melting point metal layer melts due to the pressure and temperature at the time of the collective lamination, and thus an inter metallic compound (IMC) layer may be formed, for example, at the boundary between the low melting point metal layer and the second coil pattern 212.

For example, as shown in FIGS. 4 and 5, the coil patterns 211 and 212, the lead-out portions 231 and 232, and the auxiliary lead-out portions 241 and 242 may be formed to protrude on the bottom surface and the top surface of the internal insulating layer IL, respectively. For another example, the first coil pattern 211 and the lead-out portions 231 and 232 may be formed to protrude on the bottom surface of the internal insulating layer IL, and the second coil pattern 212 and the auxiliary lead-out portions 241 and 242 are embedded in the top surface of the internal insulating layer IL, so that the top surface of the second coil pattern 212 and/or the top surfaces of the auxiliary lead-out portions 241 and 242 are exposed on the top surface of the internal insulating layer IL. In this case, since a concave portion is formed on the top surface of the second coil pattern 212 and/or the top surfaces of the auxiliary lead-out portions 241 and 242, the top surface of the internal insulating layer IL and the top surface of the second coil pattern 212, and/or the top surfaces of the auxiliary lead-out portions 241 and 242 may not be coplanar with each other.

Each of the coil patterns 211 and 212, the lead-out portions 231 and 232, the auxiliary lead-out portions 241 and 242 and the vias 221, 222, and 223 may be formed of a conductive material such as copper (Cu), aluminum (Al), silver (Ag), tin (Sn), gold (Au), nickel (Ni), lead (Pb), titanium (Ti), or an alloy thereof, but may not be limited thereto.

In the meantime, the first auxiliary lead-out portion 241 is independent of the electrical connection of the remaining components of the coil portion 200 and thus may be omitted in an exemplary embodiment. However, in detail, the first auxiliary lead-out portion 241 is formed to omit the process of distinguishing the fifth surface 105 of the body 100 from the sixth surface 106 of the body 100.

The external electrodes 300 and 400 are connected to the coil portion 200 and are spaced apart from each other on the sixth surface 106 of the body 100. Specifically, the first external electrode 300 is connected to the first lead-out portion 231. The second external electrode 400 is connected to the second lead-out portion 232. The first external electrode 300 and the second external electrode 400 are spaced apart from each other on the sixth surface 106 of the body 100.

The external electrodes 300 and 400 are formed along the internal walls of the recesses R1 and R2, respectively, and the sixth surface 106 of the body 100. For example, the external electrodes 300 and 400 are formed in the form of a conformal film on the internal walls of the recesses R1 and R2 and on the sixth surface 106 of the body 100. Each of the external electrodes 300 and 400 may be integrated as a single body on the internal walls of the recesses R1 and R2, respectively, and the sixth surface 106 of the body 100. As described above, the external electrodes 300 and 400 may be formed by a thin film process such as a sputtering process.

The external electrodes 300 and 400 may be formed of a conductive material such as copper (Cu), aluminum (Al), silver (Ag), tin (Sn), gold (Au), nickel (Ni), lead (Pb), chromium (Cr), titanium (Ti), or alloys thereof, but example thereof may not be limited thereto. The external electrodes 300 and 400 may be formed to have a monolayer structure or a multilayer structure.

The external electrodes 300 and 400 may be disposed to extend to the bottom surfaces of the recesses R1 and R2, respectively. In this case, the contact areas between the external electrodes 300 and 400 and the lead-out portions 231 and 232 may increase to improve the bonding force between the external electrodes 300 and 400 and the lead-out portions 231 and 232.

Meanwhile, although not illustrated, an exemplary embodiment may further include an insulating film formed along the surfaces of the lead-out portions 231 and 232, the coil patterns 211 and 212, the internal insulating layer IL, and the auxiliary lead-out portions 241 and 242. The insulating film is disposed to protect the lead-out portions 231 and 232, the coil patterns 211 and 212, and the auxiliary lead-out portions 241 and 242 and to isolate the lead-out portions 231 and 232, the coil patterns 211 and 212, and the auxiliary lead-out portions 241 and 242 from the body 100, and includes a well-known insulating material such as parylene. Any insulating material included in the insulating film may be used, and may not be limited. The insulating film may be formed by vapor deposition or the like, but a manner of forming the insulating film is not limited thereto. Alternatively, the insulating film may be formed by laminating an insulating film on both surfaces of the internal insulating layer IL.

In addition, in an exemplary embodiment, an external insulating layer formed on the first to fifth surfaces 101, 102, 103, 104, and 105 of the body 100 may further be included. In this case, the external insulating layer may extend to the recesses R1 and R2 to cover portions, disposed on the bottom surfaces of the recesses R1 and R2 and the internal walls of the recesses R1 and R2, of the external electrodes 300 and 400. The external insulating layer may be formed by vapor deposition or the like, but may not be limited thereto. The external insulating layer may include a thermoplastic resin (e.g., polystyrene-based resin, a vinyl acetate-based resin, a polyester-based resin, a polyethylene-based resin, a polypropylene-based resin, a polyamide-based resin, a rubber-based resin, an acrylic-based resin, or the like), a thermosetting resin (e.g., a phenol-based resin, an epoxy-based resin, a urethane-based resin, a melamine-based resin, an alkyd-based resin, or the like), a photosensitive resin, parylene, $SiO_x$ or $SiN_x$.

As described above, the coil component 1000 according to an exemplary embodiment may easily implement a bottom electrode structure while decreasing a size of the coil component. For example, unlike a related art, since the external electrode is not formed to protrude from both end surfaces 101 and 102 or both side surfaces 103 and 104 of the body 100, the overall length and the overall width of the coil component 1000 do not increase as a result of including the external electrodes 300 and 400. Furthermore, since the external electrodes 300 and 400 are relatively thin, the overall thickness of the coil component 1000 may be reduced. In addition, a contact area between the external electrodes 300 and 400 and the lead-out portions 231 and 232 increases as a result of the recesses R1 and R2 formed in the body 100 to thereby provide improved component reliability.

Figure 7:
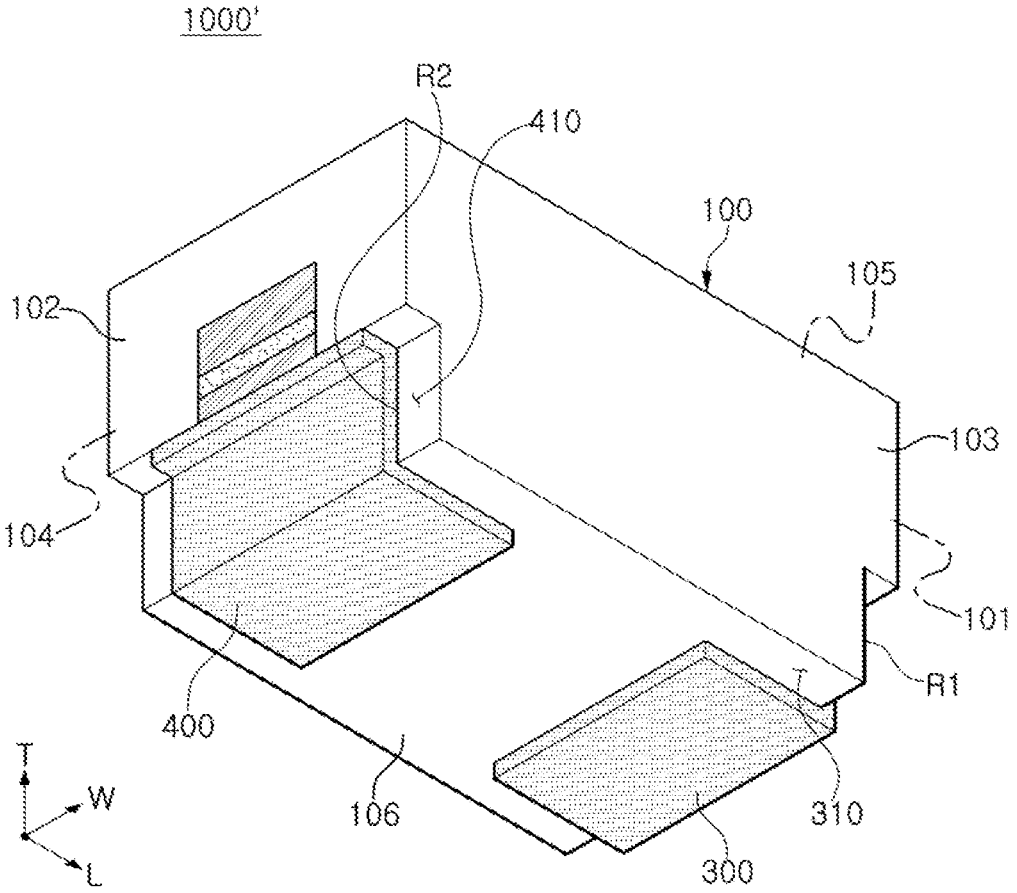
FIG. 7 illustrates a modified embodiment of a coil component, according to a first exemplary embodiment in the present disclosure, when viewed from below.

FIG. 7 illustrates a modified embodiment of a coil component, according to a first exemplary embodiment in the present disclosure, when viewed from below.

Referring to FIG. 7, in the modified embodiment, the external electrodes 300 and 400 may have widths, in a width direction of the coil component, that are smaller than the width of the coil component such that exposed portions 310 and 410 expose a portion of the internal walls of the recesses R1 and R2 and a portion of the sixth surface of the body 100. For example, the external electrodes 300 and 400 of a modified embodiment do not extend to the boundary between the recesses R1 and R2 and the third and fourth surfaces 103 and 104 of the body 100 and the boundary between the sixth surface 106 of the body 100 and the third and fourth surfaces 103 and 104.

According to the modified embodiment, a contact area between a coil component 1000' of the modified embodiment and a bonding member such as solder, used when the coil component 1000' is mounted on a printed circuit board (PCB) or the like, may be increased, for example in situations in which the bonding member extends into the exposed portions 310 and 410. For this reason, the bonding force between the bonding member and the coil component may be improved. Furthermore, in the case of the modified embodiment, since the bonding member such as solder or the like is accommodated in the exposed portions 310 and 410, the bonding member may be prevented from extending to the first and second surfaces 101 and 102 of the body 100.

Second Embodiment

Figure 8:
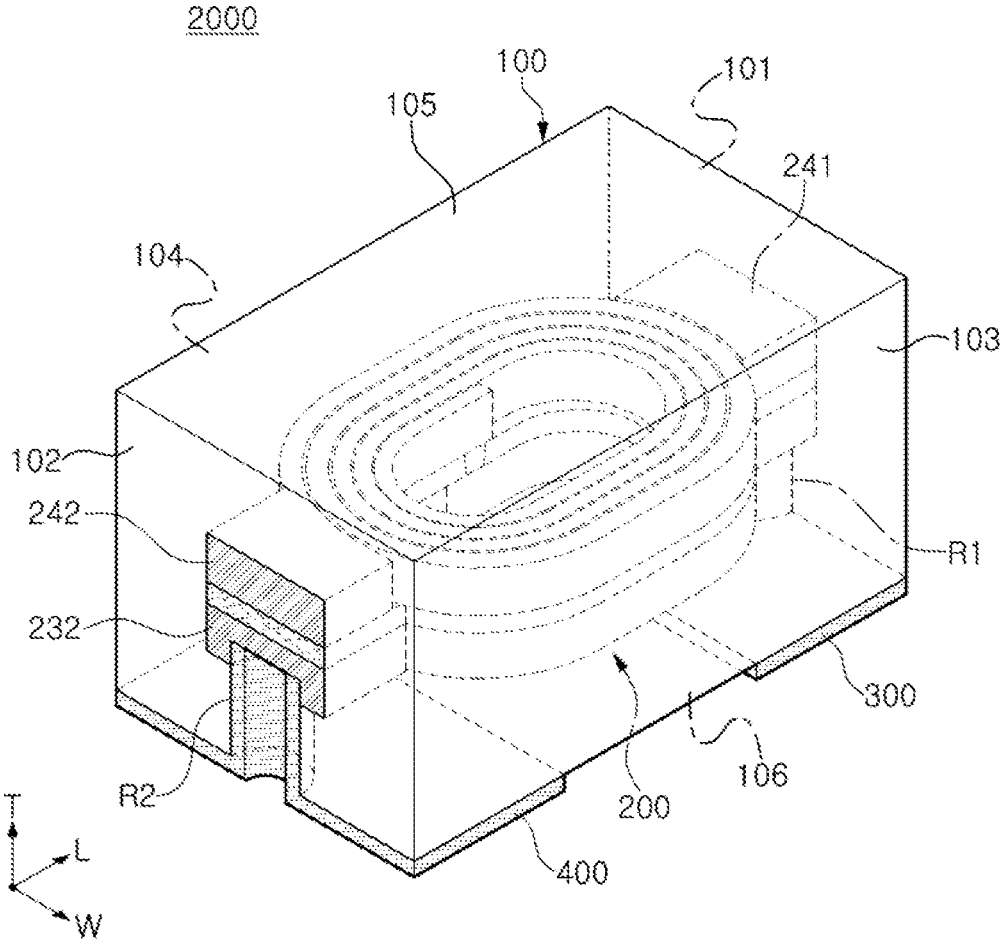
FIG. 8 illustrates a coil component according to a second exemplary embodiment in the present disclosure.
Figure 9:
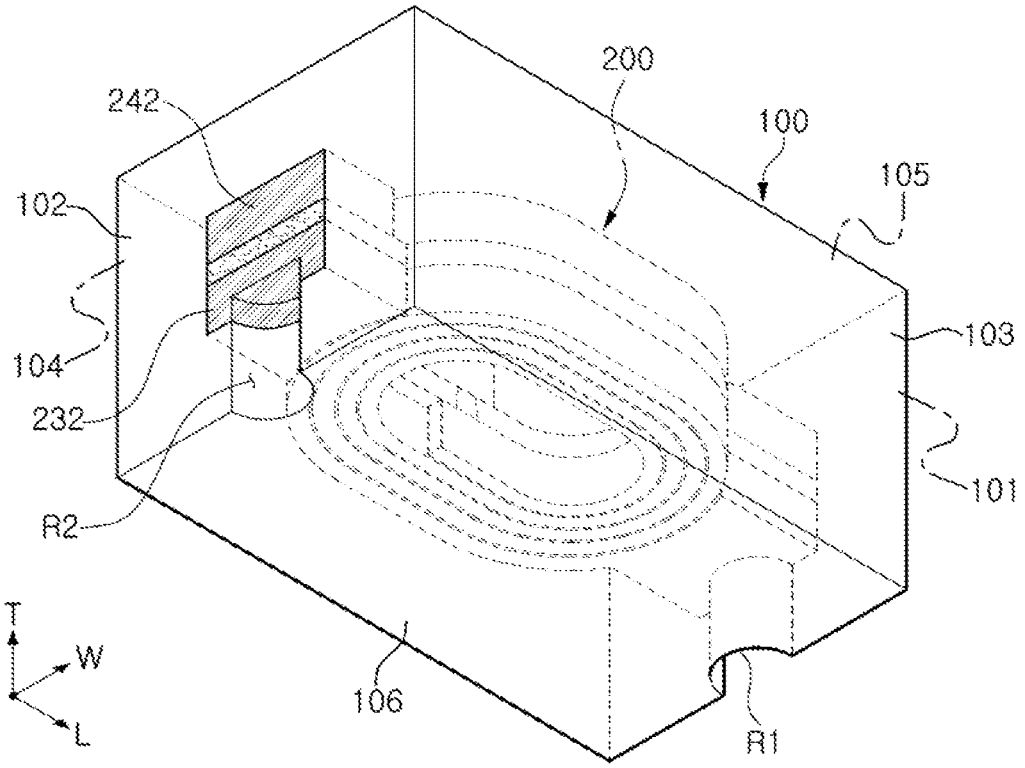
FIG. 9 is a view obtained by omitting some portions of a configuration of the coil component, according to the second exemplary embodiment in the present disclosure, when viewed from below.

FIG. 8 illustrates a coil component according to a second exemplary embodiment in the present disclosure. FIG. 9 is a view obtained by omitting some portions of a configuration of the coil component, according to the second exemplary embodiment in the present disclosure, when viewed from below. Specifically, FIG. 8 illustrates a configuration excluding an external electrode from a coil component according to an exemplary embodiment.

Referring to FIGS. 8 and 9, when a coil component 2000 according to an exemplary embodiment is compared with the coil component 1000 according to the first exemplary embodiment in the present disclosure, the recesses R1 and R2 have shapes different from those in the first embodiment. Therefore, only the shapes of the recesses R1 and R2 different from those of the first embodiment will be described. The description of the first exemplary embodiment may be applied to the other components according to the second embodiment.

Unlike in the first embodiment, the recesses R1 and R2 applied to an exemplary embodiment are not formed in the entire width direction of the body 100. For example, the recesses R1 and R2 do not extend to the third and fourth surfaces 103 and 104 of the body 100.

The recesses R1 and R2 applied to an exemplary embodiment may be formed by forming a hole or indentation in some areas of the corners respectively formed by the sixth surface 106 of the body 100 and the first and second surfaces 101 and 102 of the body 100. A diameter and a depth of the hole are adjusted such that the hole extends to the first and second lead-out portions 231 and 232 upon forming the hole. The hole extends from the sixth surface 106 to a portion of the lead-out portions 231 and 232. Accordingly, the first and second lead-out portions 231 and 232 are exposed to the internal walls and the bottom surfaces of the recesses R1 and R2.

As illustrated in FIGS. 8 and 9, each of the recesses R1 and R2 has a semicircular cross section, but a cross-sectional shape thereof is not limited thereto. Each of the recesses R1 and R2 may be transformed to have a polygonal cross section, an elliptical cross section, or the like.

Also, in the case of the modified embodiment according to an exemplary embodiment, a plurality of first recess R1 may be formed and a plurality of second recesses R2 may be formed. For example, the plurality of first recess R1 may be formed and the plurality of second recesses R2 may be formed.

Furthermore, in the case of another modified embodiment of an exemplary embodiment, similarly to the modified embodiment of the first exemplary embodiment, external electrodes 300 and 400 may not extend to boundaries between the sixth surface 106 of the body 100 and the third and fourth surfaces 103 and 104 of the body 100.

Accordingly, in the case of the present embodiment, loss of the body 100 may be reduced compared to the first embodiment in this embodiment. Therefore, the component characteristics may be prevented from degrading by improving the amount of the effective magnetic substance provided in the body 100 in the same volume.

Third Embodiment

Figure 10:
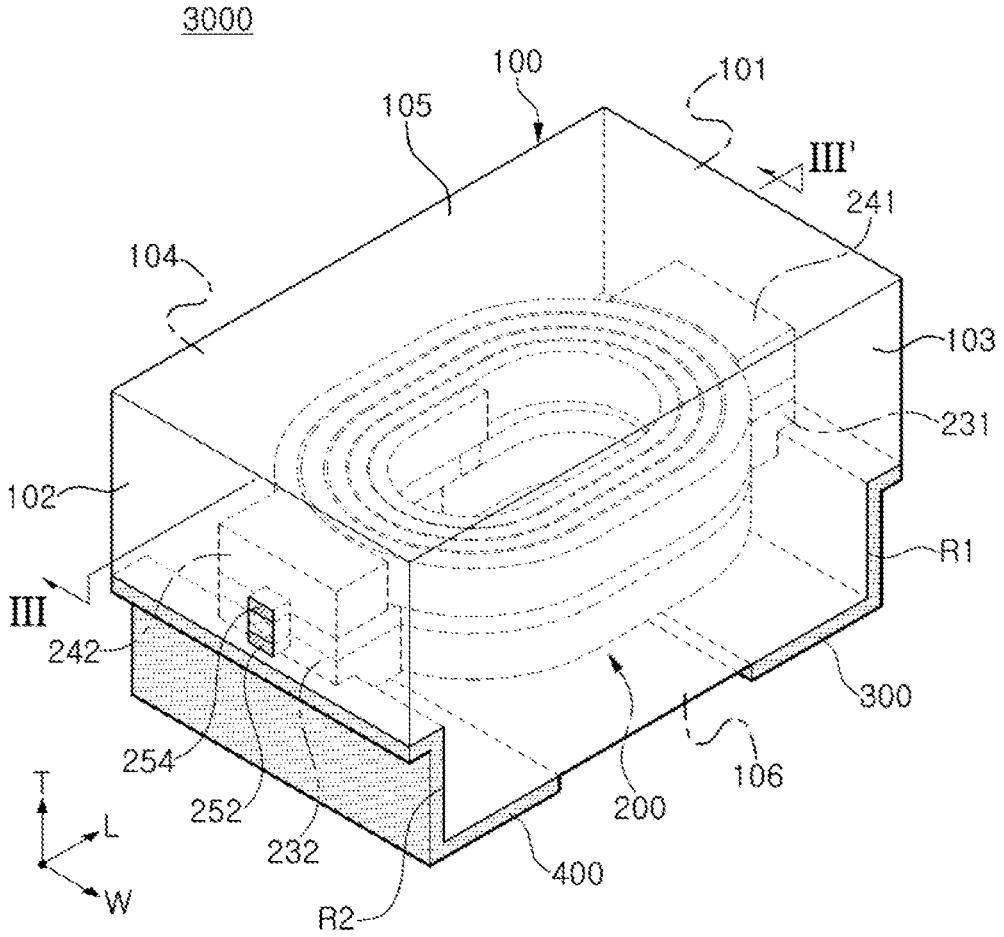
FIG. 10 illustrates a coil component according to a third exemplary embodiment in the present disclosure.
Figure 11:
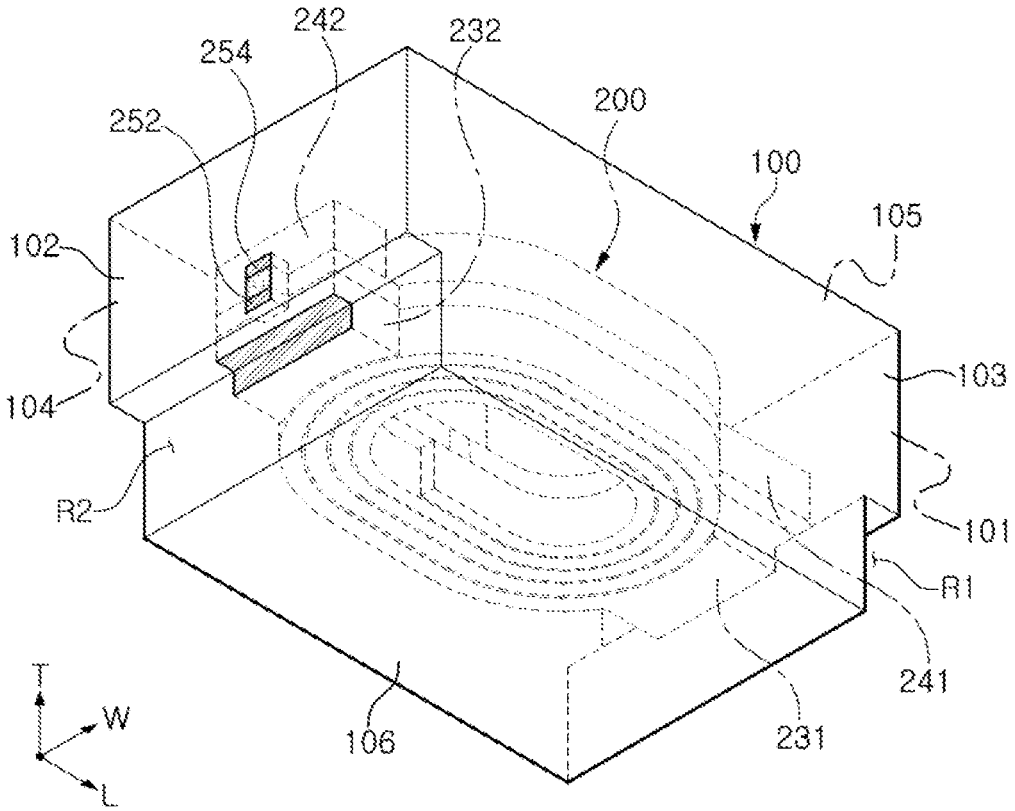
FIG. 11 is a view obtained by omitting some portions of a configuration of the coil component, according to a third exemplary embodiment in the present disclosure, when viewed from below.
Figure 12:
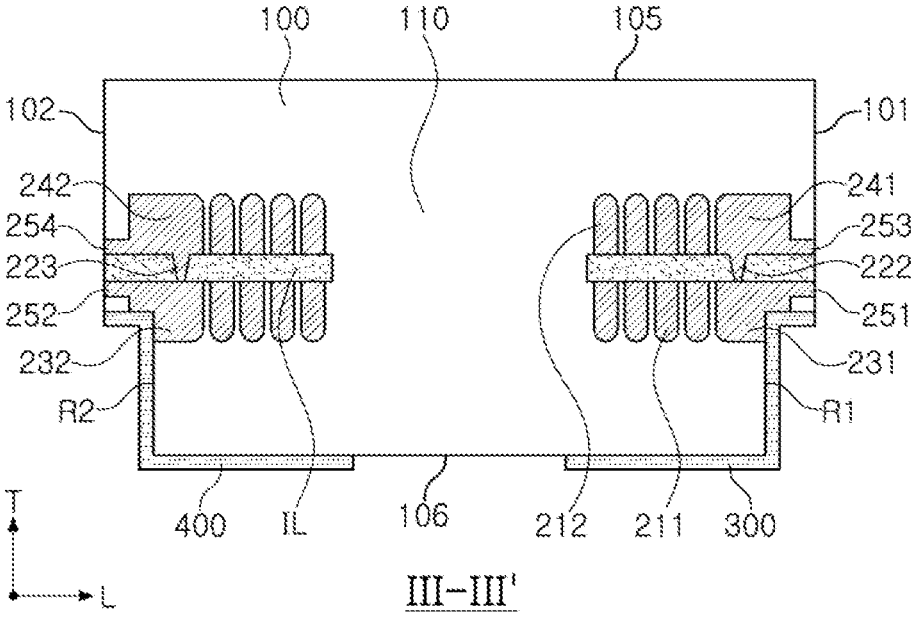
FIG. 12 is a cross-sectional view taken along line III-III' in FIG. 10.

FIG. 10 illustrates a coil component according to a third exemplary embodiment in the present disclosure. FIG. 11 is a view obtained by omitting some portions of a configuration of the coil component, according to a third exemplary embodiment in the present disclosure, when viewed from below. FIG. 12 is a cross-sectional view taken along line III-III' in FIG. 10.

Referring to FIGS. 10 to 12, when a coil component 3000 according to an exemplary embodiment is compared with each of the coil components 1000 and 2000 according to the first and second embodiments of the present disclosure, a coil portion 200 is different from the coil portions in the first and second exemplary embodiment. Therefore, only the coil portion 200 different from the coil portions of the first and second embodiments will be described. The description of the first embodiment or the second exemplary embodiment may be applied to the other components according to an exemplary embodiment.

The coil portion 200 applied to an exemplary embodiment may further include bonding reinforcing portions 251, 252, 253, and 254, which extend from the lead-out portions 231 and 232 and the auxiliary lead-out portion 241 and 242 and which are exposed to each of the first and second surfaces 101 and 102 of the body 100. Specifically, the coil portion 200 may further include a first bonding reinforcing portion 251, extending from the first lead-out portion 231, and exposed to the first surface 101 of the body 100; a second bonding reinforcing portion 252, extending from the second lead-out portion 232, and exposed to the second surface 102 of the body 100; a third bonding reinforcing portion 253, extending from the first auxiliary lead-out portion 241, and exposed to the first surface 101 of the body 100; and a fourth bonding reinforcing portion 254, extending from the second auxiliary lead-out portion 242, and exposed to the second surface 102 of the body 100. In the case of the present embodiment, unlike the first embodiment, the lead-out portions 231 and 232 and the auxiliary lead-out portions 241 and 242 are not exposed to the first and second surfaces 101 and 102 of the body 100, but the bonding reinforcing portions 251, 252, 253, and 254, which extend from the lead-out portions 231 and 232 and the auxiliary lead-out portions 241 and 242, are exposed to the end surfaces 101 and 102 of the body 100.

The bonding reinforcing portions 251, 252, 253, and 254 have widths less than widths of the lead-out portions 231 and 232 and the auxiliary lead-out portions 241 and 242, respectively. The bonding reinforcing portions 251, 252, 253, and 254 have thicknesses less than thicknesses of the lead-out portions 231 and 232 and the auxiliary lead-out portions 241 and 242, respectively. As a result, the bonding reinforcing portions 251, 252, 253, and 254 may reduce an end-side volume of the coil portion 200 to significantly reduce an area of the coil portion 200 exposed to the first and second surfaces 101 and 102 of the body 100.

Accordingly, the coil component 3000 according to an exemplary embodiment may improve the bonding force between the coil portion 200 formed on an end surface of the coil portion 200 and the body 100. For example, an effective area of the body 100 may be improved on an outermost surface of the coil component 3000 by providing the bonding reinforcing portions 251, 252, 253, and 254, each having a volume smaller than a volume of each of the lead-out portions 231 and 232 and the auxiliary lead-out portions 241 and 242, on the outermost surface of the body 100 of the coil portion 200.

Furthermore, the coil component 3000 according to an exemplary embodiment improves the effective volume of the magnetic body to prevent component characteristics from deteriorating.

In addition, the coil component 3000 according to an exemplary embodiment may reduce an area of the coil portion 200 exposed to the end surfaces 101 and 102 of the body 100 to prevent an electrical short-circuit.

In the meantime, the present embodiment may be modified in the same manner as the modified embodiment of the first exemplary embodiment. For example, in the case of the modified embodiment according to an exemplary embodiment, external electrodes 300 and 400 may not extend to the boundary between the recesses R1 and R2 and the third and fourth surfaces 103 and 104 of the body 100 and the boundary between the sixth surface 106 of the body 100 and the third and fourth surfaces 103 and 104.

Fourth Embodiment

Figure 13:
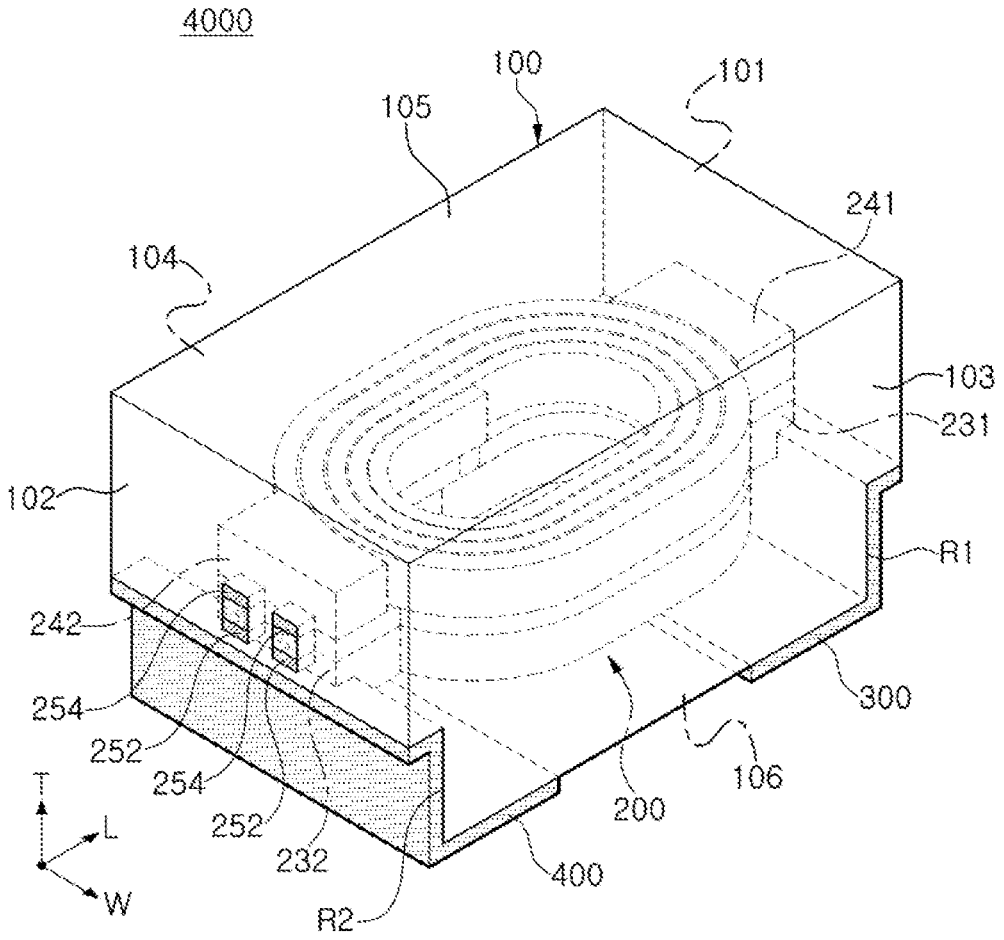
FIG. 13 illustrates a coil component according to a fourth exemplary embodiment in the present disclosure.

FIG. 13 illustrates a coil component according to a fourth exemplary embodiment in the present disclosure.

Referring to FIG. 13, when a coil component 4000 according to an exemplary embodiment is compared with the coil component 3000 according to the third exemplary embodiment, the bonding reinforcing portions 251 (not shown), 252, 253 (not shown), and 254 of the coil portion 200 are different from those of the third exemplary embodiment. Therefore, only the coil portion 200 different from that of the third embodiment will be described. The description of the first to third embodiments may be applied to the remaining components according to an exemplary embodiment in the present disclosure.

A plurality of bonding reinforcing portion 251 (not shown), a plurality of bonding reinforcing portion 252, a plurality of bonding reinforcing portion 253 (not shown), and a plurality of bonding reinforcing portion 254, applied to an exemplary embodiment, may be formed at the lead-out portions 231 and 232 and the auxiliary lead-out portions 241 and 242, respectively. Specifically, at least one of the plurality of first bonding reinforcing portion 251, extending from the first lead-out portion 231, and exposed to the first surface 101 of the body 100, of the plurality of second bonding reinforcing portion 252, extending from the second lead-out portion 232, and exposed to the second surface 102 of the body 100, of the plurality of third bonding reinforcing portion 253, extending from the first auxiliary lead-out portion 241, and exposed to the first surface 101 of the body 100, and of the plurality of fourth bonding reinforcing portion 254, extending from the second auxiliary lead-out portion 242, and exposed to the second surface 102 of the body 100 may be formed.

Accordingly, the coil component 4000 according to an exemplary embodiment may increase a contact area between the coil portion 200 and the body 100 to mutually improve bonding force therebetween In the meantime, an exemplary embodiment may be modified in the same manner as the modified embodiment of the first exemplary embodiment. For example, in the case of the other modified embodiment according to an exemplary embodiment, the external electrodes 300 and 400 may not extend to the boundary between the recesses R1 and R2 and the third and fourth surfaces 103 and 104 of the body 100 and the boundary between the sixth surface 106 of the body 100 and the third and fourth surfaces 103 and 104.

According to an exemplary embodiment, a size of a coil component may be reduced.

Moreover, according to an exemplary embodiment, a bottom electrode structure may be easily formed.

Moreover, according to an exemplary embodiment, a shielding structure may be easily formed.

While exemplary embodiments have been shown and described above, it will be apparent to those skilled in the art that modifications and variations could be made without departing from the scope of the present invention as defined by the appended claims.

What is claimed is:

1. A coil component comprising:

a body having one surface and another surface, disposed to oppose each other in one direction, and a plurality of wall surfaces connecting the one surface of the body to the other surface of the body;

an internal insulating layer embedded in the body;

a pair of recesses, each disposed in a respective end surface of a pair of opposing end surfaces of the body among the plurality of wall surfaces of the body, and each extending to the one surface of the body;

a coil portion including first and second lead-out portions disposed on one surface of the internal insulating layer to be spaced apart from each other, the coil portion being exposed to an internal wall and a bottom surface of each of the pair of recesses; and first and second external electrodes each disposed along the internal wall of a respective one of the pair of recesses and disposed along the one surface of the body to be connected to the coil portion, wherein the first and second external electrodes are disposed on the one surface of the body to be spaced apart from each other, wherein the internal wall and bottom surface of each of the pair of recesses extend in directions which intersect each other, and wherein the first and second lead-out portions are exposed from both the internal wall and the bottom surface of a corresponding recess.

2. The coil component of claim 1, wherein each of the first and second external electrodes is integrated on the internal wall of the respective recess as a single body on the internal wall of the respective recess and the one surface of the body.

3. The coil component of claim 1, wherein each of the first and second external electrodes is disposed to extend to the bottom surface of the recess.

4. The coil component of claim 1, wherein surface roughness of one surface of each of the first and second lead-out portions that is exposed to a recess of the pair of recesses is higher than surface roughness of another surface of each of the first and second lead-out portions other than the one surface.

5. The coil component of claim 1, wherein the first and second lead-out portions continuously extend from the internal wall to the bottom surface of the corresponding recess.

6. The coil component of claim 1, wherein each recess extends to a pair of side surfaces of the body connecting both end surfaces of the body to each other among the plurality of wall surfaces of the body.

7. The coil component of claim 6, wherein each of the first and second external electrodes is spaced apart from each of the pair of side surfaces of the body.

8. The coil component of claim 1, wherein the coil portion further includes:

a first coil pattern disposed on the one surface of the internal insulating layer to be in contact with the first lead-out portion and to be spaced apart from the second lead-out portion;

a second coil pattern disposed on another surface of the internal insulating layer disposed oppose to the one surface of the internal insulating layer; and a via penetrating through the internal insulating layer to connect the first coil pattern and the second coil pattern to each other.

9. The coil component of claim 8, wherein the first and second lead-out portions are each exposed to a respective end surface of the body.

10. The coil component of claim 8, wherein the coil portion further includes:

a pair of bonding reinforcing portions, each extending from a respective one of the first and second lead-out portions, and each exposed to a respective one of the end surfaces of the body.

11. The coil component of claim 10, wherein the bonding reinforcing portion has a thickness less than a thickness of each of the first and second lead-out portions.

12. The coil component of claim 11, wherein the bonding reinforcing portion has a width less than a width of each of the first and second lead-out portions.

13. The coil component of claim 8, wherein the coil portion further includes:

an auxiliary lead-out portion, disposed on the other surface of the internal insulating layer to be in contact with the second coil pattern and connected to the second lead-out portion.

14. The coil component of claim 13, wherein the first lead-out portion is exposed to one end surface of the body, and each of the second lead-out portion and the auxiliary lead-out portion is exposed to the other end surface of the body.

15. The coil component of claim 13, wherein the coil portion further includes:

a bonding reinforcing portion, extending from each of the first lead-out portion, the second lead-out portion, and the auxiliary lead-out portion, exposed to each of the end surfaces of the body.

16. The coil component of claim 8, wherein the coil portion further includes:

a first auxiliary lead-out portion disposed on the other surface of the internal insulating layer to be spaced apart from the second coil pattern, and connected to the first lead-out portion; and a second auxiliary lead-out portion disposed on the other surface of the internal insulating layer to be in contact with the second coil pattern, and connected to the second lead-out portion.

17. The coil component of claim 16, wherein each of the first lead-out portion and the first auxiliary lead-out portion is exposed to one end surface of the body, and each of the second lead-out portion and the second auxiliary lead-out portion is exposed to the other end surface of the body.

18. The coil component of claim 16, wherein the coil portion further includes:

a bonding reinforcing portion, extending from each of the first lead-out portion, the second lead-out portion, the first auxiliary lead-out portion, and the second auxiliary lead-out portion, exposed to each of both end surfaces of the body.

19. A coil component comprising:

a body having an top surface and a bottom surface, disposed to oppose each other, a pair of end surfaces, disposed to connect the top surface and the bottom surface to each other and to oppose each other, and a pair of side surfaces, disposed to connect to both end surfaces;

an internal insulating layer embedded in the body;

a coil portion including first and second lead-out patterns, disposed on one surface of the internal insulating layer disposed to face the bottom surface of the body and spaced apart therefrom, having end portions each exposed to a respective end surface of the body, the coil portion including a first coil pattern, disposed between the first lead-out pattern and the second lead-out pattern to be in contact with the first lead-out pattern and to be spaced apart from the second lead-out pattern;

a pair of recesses, each disposed in a respective corner between the bottom surface of the body and a respective end surface of the body, and extending to each of the first and second lead-out patterns; and first and second external electrodes each integrated as a single body along a bottom surface of a respective recess of the pair of recesses, an internal wall of the respective recess, and the bottom surface of the body, wherein the first and second external electrodes are spaced apart from each other on the bottom surface of the body, wherein the internal wall and bottom surface of each of the pair of recesses extend in directions which intersect each other, and wherein the first and second lead-out portions are exposed from both the internal wall and the bottom surface of a corresponding recess.

20. The coil component of claim 19, wherein the first and second lead-out portions continuously extend from the internal wall to the bottom surface of the corresponding recess.

21. A coil component comprising:

a body having first and second surfaces opposing each other in a first direction, third and fourth surfaces opposing each other in a second direction, and fifth and sixth surfaces opposing each other in a third direction;

a coil disposed in the body to be substantially parallel to the first surface and spaced apart from the first surface, and including first and second lead-out portions connected to respective ends of the coil;

first and second recesses disposed in the third and fourth surfaces of the body, respectively, and each extending from the first and second lead-out portions, respectively, to the first surface of the body; and first and second external electrodes disposed in the first and second recesses, respectively, connected to the first and second lead-out portions, respectively, and disposed on the first surface of the body to be spaced apart from each other, wherein the first and second recesses each have an internal wall and a bottom surface extending in directions which intersect each other, and wherein the first and second lead-out portions are exposed from both the internal wall and the bottom surface of a corresponding recess.

22. The coil component of claim 21, wherein a thickness of the first and second external electrodes, measured orthogonally to the third and fourth surfaces of the body, is less than a depth of the first and second recesses, measured orthogonally to the third and fourth surfaces.

23. The coil component of claim 21, wherein the first and second recesses each extend to the fifth and sixth surfaces of the body.

24. The coil component of claim 21, wherein the first and second recesses are each spaced apart from the fifth and sixth surfaces of the body.

25. The coil component of claim 21, wherein the first and second lead-out portions extend to the third and fourth surfaces of the body, respectively, and extend to the first and second recesses, respectively.

26. The coil component of claim 21, wherein the first and second recesses have semicircular cross sections.

27. The coil component of claim 21, wherein the first and second lead-out portions continuously extend from the internal wall to the bottom surface of the corresponding recess.

* * * * *